US005390010A

United States Patent [19]

Yamahata et al.

[11] Patent Number: 5,390,010

[45] Date of Patent: Feb. 14, 1995

[54] DRIVE MECHANISM FOR AN ELECTROPHOTOGRAPHIC APPARATUS FOR ENSURING EQUAL ROTATIONAL SPEEDS OF INTERMEDIATE TRANSFER AND PHOTOSENSITIVE DEVICES

[75] Inventors: Makoto Yamahata, Chikushino; Tomonori Takayama, Fukuoka, both of Japan

[73] Assignee: Matsushita Electric Industrial Co., Ltd., Osaka, Japan

[21] Appl. No.: 40,087

[22] Filed: Mar. 30, 1993

[30] Foreign Application Priority Data

Apr. 10, 1992 [JP] Japan ..... 4-090520

[51] Int. Cl.[6] ..... G03G 15/14

[52] U.S. Cl. ..... 355/271

[58] Field of Search ..... 355/271, 274, 277

[56] References Cited

U.S. PATENT DOCUMENTS

| | | | |
|---|---|---|---|
| 4,183,658 | 1/1980 | Winthaegen | 355/277 X |
| 4,788,572 | 11/1988 | Slayton et al. | 355/317 |
| 5,132,743 | 7/1992 | Bujese et al. | 355/274 |
| 5,196,893 | 3/1993 | Nishise et al. | 355/271 |
| 5,208,638 | 5/1993 | Bujese et al. | 355/274 |

FOREIGN PATENT DOCUMENTS 4-199165 7/1992 Japan .

*Primary Examiner*—Fred L. Braun

*Attorney, Agent, or Firm*—Pollock, Vande Sande & Priddy

[57] ABSTRACT

An electrophotographic apparatus is provided for forming an electrostatic latent image on a photosensitive device to form a composite image on an intermediate transfer device which is in turn transferred onto a transfer sheet. Power from one drive motor is first transmitted to the intermediate transfer side and then transmitted to the photosensitive device side so that both the photosensitive device and intermediate transfer device are driven by one drive motor. Thus, even if the peripheral speed of the intermediate transfer device temporarily varies due to the contacting and separating operations of a cleaning device and a transfer roller with respect to the intermediate transfer device, the rotational speeds of the intermediate transfer device and the photosensitive device always become equal to each other to prevent a deterioration of the image quality to be outputted.

8 Claims, 5 Drawing Sheets

DRIVE MECHANISM FOR AN ELECTROPHOTOGRAPHIC APPARATUS FOR ENSURING EQUAL ROTATIONAL SPEEDS OF INTERMEDIATE TRANSFER AND PHOTOSENSITIVE DEVICES

BACKGROUND OF THE INVENTION

The present invention relates to an electrophotographic apparatus which forms an electrostatic latent image on a photosensitive device to form a toner image which is in turn transferred onto a transfer member.

An electrophotographic apparatus bases the electrophotographic process technique and is generally of the type using a dry toner and is put into practice as copying apparatus or laser printers. The color electrophotographic apparatus basically comprises a photosensitive device for forming an electrostatic latent image by applying light thereto to form a toner image corresponding to the formed electrostatic latent image. Further, in a color electrophotographic apparatus, included is an intermediate transfer device for formation of a color composite toner image. The quality of image to be outputted greatly depends upon the coincidence in relative driving speed between the photosensitive device and the intermediate transfer device. However, as will be described hereinafter, a conventional color electrophotographic apparatus is arranged such that the photosensitive device and the intermediate transfer device are driven by different drive motors, and a cleaning device and a transfer roller are brought into contact with and separated from the intermediate transfer device and hence the load to be applied to the drive motor for the intermediate transfer device varies so that the driving speed of the intermediate transfer device varies. When the driving speed of one of the different motors varies, the difference in speed between the photosensitive device and the intermediate transfer device occurs to thereby deteriorate the image quality.

SUMMARY OF THE INVENTION

It is therefore an object of the present invention to present a color electrophotographic apparatus which is capable of preventing, the deterioration of the quality of an image to be outputted.

According to this invention, a power from one drive motor is first transmitted to the intermediate transfer device side and then transmitted to the photosensitive device side so that both the photosensitive device and intermediate transfer device are driven by one drive motor. Thus, even if the peripheral speed of the intermediate transfer device temporarily varies due to the contacting and separating operations of a cleaning device and a transfer roller with respect to the intermediate transfer device, the rotational speeds of the intermediate transfer device and the photosensitive device always become equal to each other to prevent a deterioration of the image quality to be outputted.

BRIEF DESCRIPTION OF THE DRAWINGS

The object and features of the present invention will become more readily apparent from the following detailed description of the preferred embodiments taken in conjunction with the accompanying drawings in which.

DETAILED DESCRIPTION OF THE INVENTION

Figure 5:
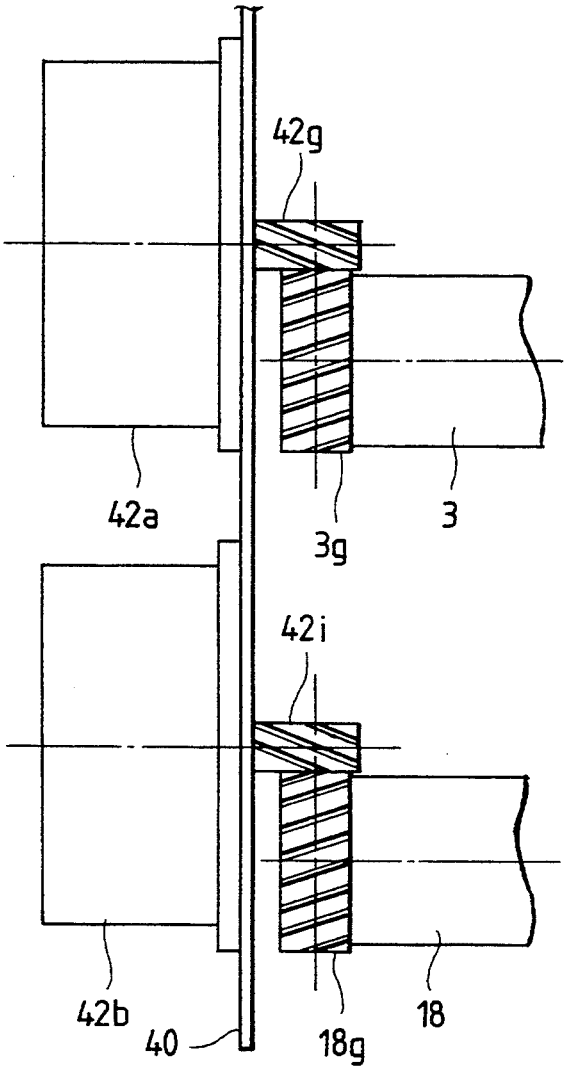
FIG. 5 PRIOR ART
FIG. 5 is an enlarged view showing an arrangement of a drive section for a photosensitive device and an intermediate transfer device in the FIG. 4 conventional electrophotographic apparatus.
Figure 4:
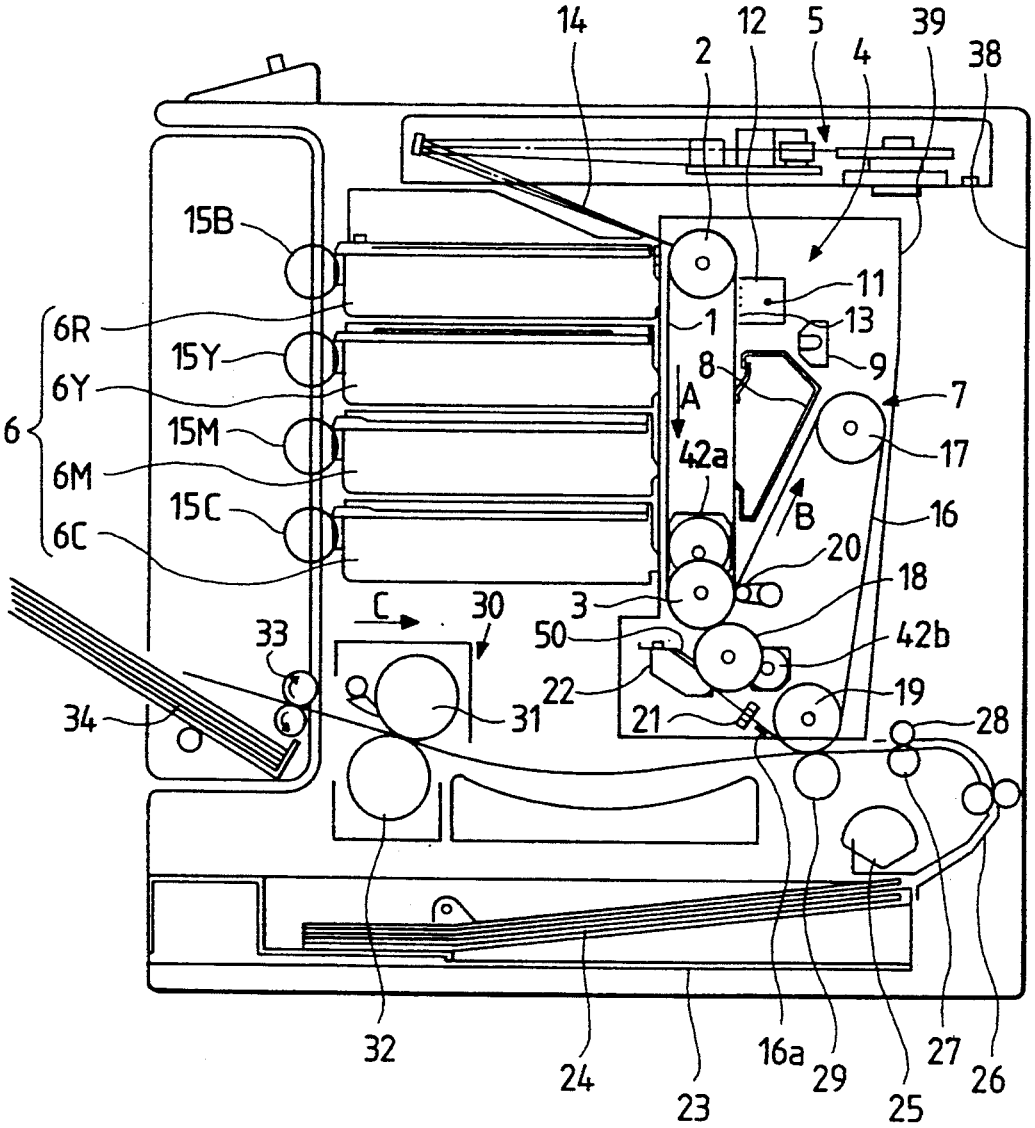
FIG. 4 PRIOR ART
FIG. 4 is a cross-sectional view showing an arrangement of a conventional electrophotographic apparatus.

Prior to describing a color electrophotographic apparatus according to this invention, a brief description will be made hereinbelow with reference to FIGS. 4 to 7 in terms of a conventional color electrophotographic apparatus. FIG. 4 shows an entire arrangement of the conventional color electrophotographic apparatus and FIG. 5 is an enlarged view showing a photosensitive device and an intermediate transfer device of the FIG. 4 conventional color electrophotographic apparatus. In FIG. 4, designated at numeral 1 is a photosensitive device comprising a jointless closed-loop belt-like member made of a resin or the like and having on its circumferential surface a thin film-like photosensitive layer such as a selenium (Se) and an organic photoconductive material (OPC) applied. This photosensitive device 1 is supported by two photosensitive devices conveying rollers 2 and 3 so as to form a vertical plane. As illustrated in FIG. 5 a motor shaft gear (toothed wheel) 42*g* of a drive motor 42*a* which is a drive source is engaged with a gear 3*g* provided at one end of the conveying roller 3, whereby the photosensitive device 1 can rotate in a direction indicated by an arrow A in FIG. 4. Around the belt-like photosensitive device 1 there are provided a charger 4, an exposure optical system 5, black (B), yellow (Y), magenta (M) and cyan (C)-color developing devices 6B, 6Y, 6M and 6C, an intermediate transfer unit 7, a photosensitive device cleaning device 8 and a charge-removing device 9 arranged in order in the rotating direction of the photosensitive device 1 indicated by the arrow A. Of these devices, the exposure optical system 5 and the developing devices 6B, 6Y, 6M, 6C are placed on a chassis 38. Further, the photosensitive device 1, cleaning device 8, charger 4, charge-removing device 9 and intermediate transfer unit 7 are provided on a chassis 39. Here, the photosensitive device 1, intermediate transfer unit 7 and others are arranged to be detachable from the chassis 39. The charger 4 comprises a charging wire 11 made of a tungsten wire, a shield plate 12 made of a metallic plate, and a grid plate 13. In response to a high voltage applied, the charging wire 11 gives rise to corona discharge whereby the photosensitive device 1 can evenly be charged through the grid plate 13. The exposure optical system 5 is controlled in accordance with a signal from a host computer or the like to generate an exposure beam 14 modulated in accordance with image data, thereby forming an electrostatic latent image on the photosensitive device 1.

Figure 6:
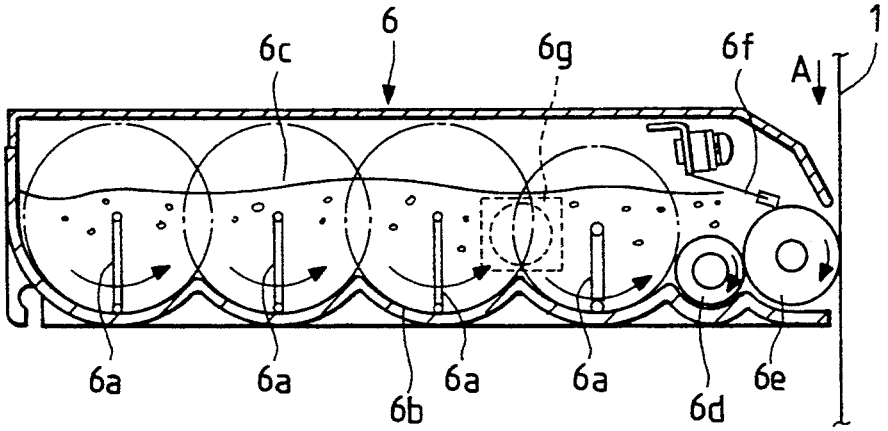
FIG. 6 PRIOR ART
FIG. 6 is a cross-sectional view showing an arrangement of a developing device in the conventional electrophotographic apparatus.

FIG. 6 is a cross-sectional view showing an arrangement of the developing device. In FIG. 6, 6*a* represents a plurality of toner carrying members which are disposed at a predetermined interval, each of which is constructed by a wire made of stainless steel or the like. The toner carrying member 6*a* is bent to form a rectangular configuration, both ends of which are rotatably supported by a developing pad 6*b*. The toner carrying member 6*a* is for blocking a toner 6*c* within the developing device 6 and further for conveying the toner 6*c* onto a supply roller 6*d*. This supply roller 6*d* is at its both ends supported rotatably by the developing pad 6*b* so as to supply the toner 6*c*, carried by the toner carrying members 6*a*, onto a surface of a developing roller 6*e*. This supply roller 6*d* is constructed with a conductive layer such as an urethane being formed on the outer circumference of a base made of a metal such as stainless steel. Similarly, the developing roller 6*e* is constructed with a conductive layer such as a silicon and an urethane being formed on the outer circumference of a base made of a metal such as stainless steel, and both the ends of the developing roller 6*e* are rotatably supported by the developing pad 6*b*. A toner restricting blade 6*f*, being made of a conductive member such as a silicon and an urethane, gives charges to the toner 6*c* from the supply roller 6*d* and forms a thin film of the toner 6*c* on the developing roller 6*e*. The developing roller 6*e* comes into contact with the photosensitive device 1 so as to form on the photosensitive device 1 a toner image corresponding to a previously formed electrostatic latent image. In FIG. 6, 6*g* designates a sensor for sensing the remaining amount of the toner 6*c* within the developing device 6 to generate a signal indicative of the necessity of exchange of the developing device 6.

Returning back to FIG. 4, each developing device 6 encases the corresponding toner 6*c*, and for selection of color, one of cams 15B, 15Y, 15M and 15C is rotated in accordance with a color selection signal from a host computer or the like so as to bring the corresponding developing device 6 into contact with the photosensitive device 1. Each of the cams 15B, 15Y, 15M and 15C is at its both ends supported rotatably by the apparatus body. The non-selected remaining developing devices 6 takes the separated state from the photosensitive device 1.

Figure 7:
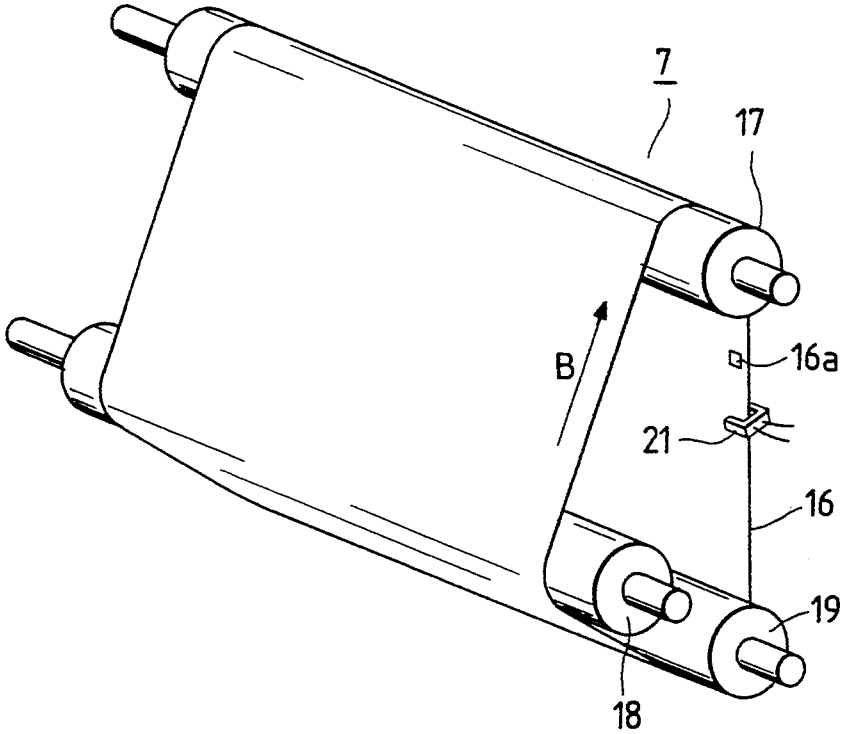
FIG. 7 PRIOR ART
FIG. 7 is a perspective view showing an arrangement of an intermediate transfer device in the conventional electrophotographic apparatus.

FIG. 7 is a perspective view showing the intermediate transfer unit 7. In FIG. 7, the intermediate transfer unit 7 comprises a jointless loop-belt-like intermediate transfer device 16, three intermediate transfer device conveying rollers 17, 18, 19 for supporting the intermediate transfer device 16 and for rotating it in a direction indicated by an arrow B, and an intermediate transfer roller 20 (see FIG. 4) for transferring a toner image on the photosensitive device 1 onto the intermediate transfer device 16. The intermediate transfer roller 20 is disposed to be in opposed relation to the photosensitive device 1 so that the intermediate transfer device 16 is interposed therebetween. As illustrated in FIG. 5, a gear 18*g* provided at one end of the conveying roller 18 is arranged to be engaged with a motor shaft gear 42*i* of the drive motor 42*b*. In FIG. 7, 21 denotes a reference sensor for detecting a reference position of the intermediate transfer device 16. The reference position thereof can be detected on the basis of a reference mark such as a slit 16*a* formed at an end portion of the intermediate transfer device 16.

Returning again to FIG. 4, numeral 22 depicts an intermediate transfer cleaning device for raking and removing the remaining toner on the intermediate transfer device 16. A blade 50 is brought into contact with the intermediate transfer device 16 to remove the remaining toner, thereby cleaning the intermediate transfer device 16. The blade 50 of the cleaning device 22 takes a separated position from the intermediate transfer device 16 while forming a composite image on the intermediate transfer device 16, and comes into contact therewith only when cleaning the intermediate transfer device 16. Further, designated at numeral 23 is a transfer member cassette for encasing transfer members (sheets, paper) 24. The transfer members 24 are fed from the transfer member cassette 23 by one to a transfer member conveying passage 26 by means of a feed roller 25 having a semicylindrical configuration. Denoted at numeral 27 is a resist roller for temporarily stopping the transfer member 24 so that the transfer member 24 takes a waiting state, whereby the transfer position of the transfer member 24 becomes coincident with the position of the composite image on the intermediate transfer device 16. The resist roller 27 is brought in contact with a driven roller 28 under a pressure. Further, designated at numeral 29 is a transfer roller for transferring the composite image on the intermediate transfer device 16 onto the transfer member 24. The transfer roller 29 rotationally comes into contact with the intermediate transfer device 16 only when transferring the composite image onto the transfer member 24. Denoted at numeral 30 is a fixing device comprising a heating roller 31 having a heat source therein and a pressing roller 32. The heating roller 31 and the pressing roller 32 hold the transfer member 24 and rotate so that the composite image on the transfer member 24 is fixed to the transfer member 24 due to pressure and heat to form a color image. Numeral 33 depicts a transfer member discharging roller constructed with an elastic layer such as an urethane being placed on the outer circumference of a base made of a metal such as a stainless steel. The transfer member discharging roller 33 is rotatably supported at it transfer member 24 discharging side end portion of the apparatus body so that the color image-formed transfer member 24 is discharged on the previously discharged transfer members 24 within a transfer member storage device 34 in a state that the color image side of the transfer member 24 becomes the upper side.

Secondly, a description will be made hereinbelow in terms of an operation of the electrophotographic apparatus thus arranged. The photosensitive device 1 and the intermediate transfer device 16 are driven by the drive sources 42*a* and 42*b* as shown in FIG. 5 so that the peripheral speeds thereof becomes constant and equal to each other. Further, the intermediate transfer device 16 has an image-transferred area previously set by the intermediate transfer device reference sensor 21 for detecting the reference mark 16*a* to determine a reference position as illustrated in FIG. 7. In this state, a high voltage is applied to the charging wire 11 of the charger 4 connected to a high-voltage source so that the corona discharge occurs, while the photosensitive device 1 is rotated in the arrow A direction, whereby the surface of the photosensitive device 1 is evenly charged to about −700 to −800 V. An exposure beam such as a laser beam 14 corresponding to a given component (for example, black B) of a plurality of color components is applied onto the evenly charged surface of the photosensitive device 1. Due to this application of the exposure beam 14, the charges in the beam-applied portion of the photosensitive device 1 are removed so as to form an electrostatic latent image thereon. At this time, the electrostatic latent image formed area is determined in accordance with a signal from the reference sensor 21 for detecting the reference position of the intermediate transfer device 16.

On the other hand, the cam 15B rotates in accordance with a color selection signal from a host computer or the like so that the developing device 6B which encases the black toner 6c for development is pressed in an arrow C direction to be brought into contact with the photosensitive device 1. With this contact, the toner 6c is attached to the electrostatic latent image portion on the photosensitive device 1 so as to form a toner image. After the completion of the development, the developing device 6B moves from the contact position up to the separated position by means of rotation of the cam 15B by 180 degrees. The toner image formed on the photosensitive device 1 by the developing device 6B is transferred onto the intermediate transfer device 16 with a high voltage being applied to the intermediate transfer roller 20. This transfer operation is effected at every color. The remaining toner not transferred from the photosensitive device 1 onto the intermediate transfer device 16 is removed by the cleaning device 8 before the charges on the photosensitive device i are removed by the charge-removing device 9.

Then, for example, an electrostatic latent image corresponding to cyan (C) is formed on the photosensitive device 1 before rotating the cam 15C to push the developing device 6C toward the photosensitive device 1 which in turn comes into contact with the photosensitive device 1 for the cyan (C) development. In the case of a copying machine or printer using four colors, the aforementioned developing operation is repeatedly effected four times so as to overlap the black (B), cyan (C), magenta (M) and yellow (Y) toner images on the intermediate transfer device 16 to form a composite image thereon. The entire composite image thus formed is transferred onto the transfer member 24, fed from the transfer member cassette 23 through the conveying passage 26, with the transfer roller 29 being brought into contact with and pressed against the intermediate transfer device 16 and a high voltage being applied to the transfer roller 29.

Subsequently, the transfer member 24 to which the toner image is transferred is supplied to the fixing device 30 to be fixed by the heat of the heating roller 31 and the holding pressure by the heating roller 31 and the pressing roller 32 and then discharged onto the transfer member storage device by the rotation of the transfer member discharging roller 33 in the direction indicated by an arrow. The remaining toner on the intermediate transfer device 16 is removed by the cleaning device 22. This cleaning device 22 takes the separated position from the intermediate transfer device 16 until the composite image is formed on the intermediate transfer device 16, and takes the contact state with the intermediate transfer device 16 to remove the remaining toner after the composite image is transferred onto the transfer member 24 by the transfer roller 29. At this time, the image recording is completed.

In the above-described conventional electrophotographic apparatus, since the photosensitive device 1 and the intermediate transfer device 16 are driven by different drive motors 42a and 42b, and the cleaning device 22 and the transfer roller 29 are brought into contact with and separated from the intermediate transfer device 16, the load or force to be applied to the drive motor 42b for the intermediate transfer device 16 varies so that the driving speed of the intermediate transfer device 16 varies. The variation of the driving speed of one of the different motors 42a and 42b causes the difference in speed between the photosensitive device and the intermediate transfer device to occur so that a slippage occurs at the transfer portions, thereby deteriorating the image quality.

Figure 1:
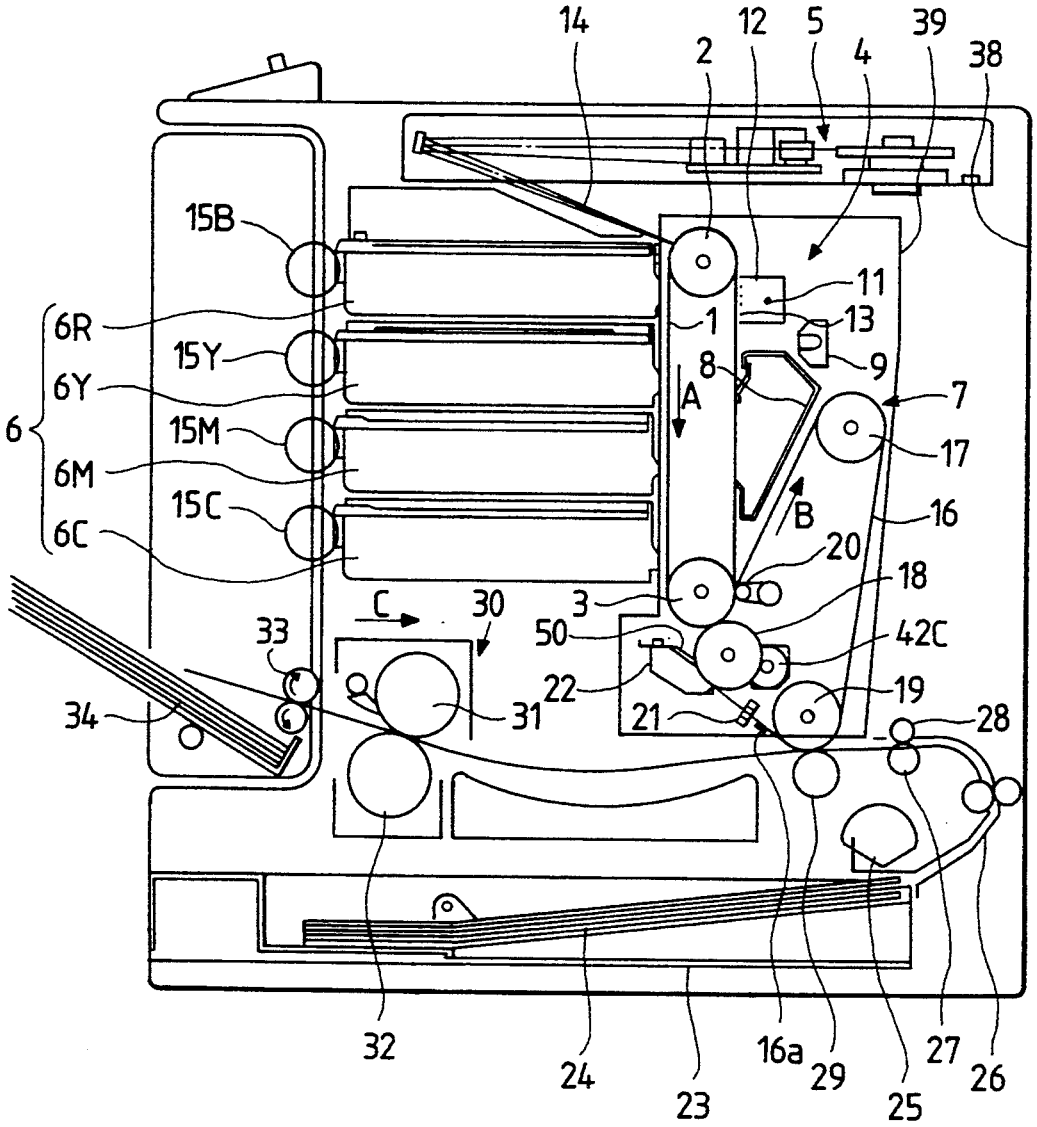
FIG. 1 is a cross-sectional view showing an arrangement of an electrophotographic apparatus according to an embodiment of this invention.
Figure 2:
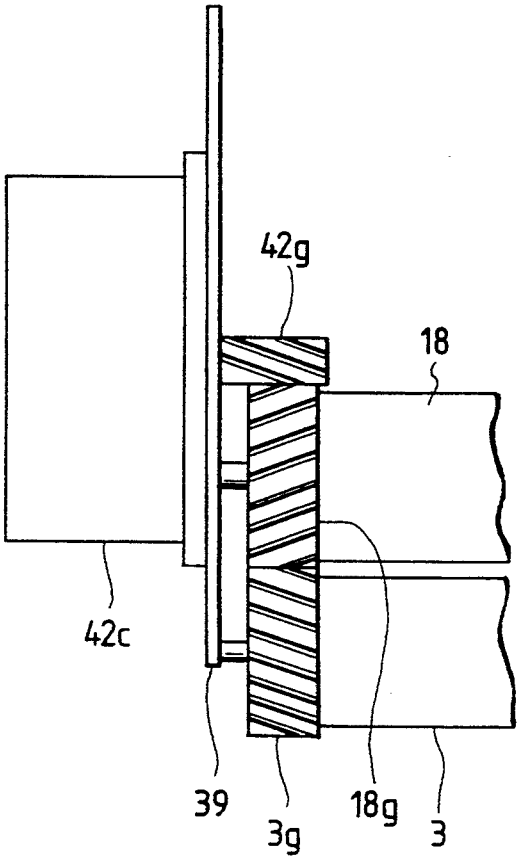
FIG. 2 is an enlarged view showing a drive section for a photosensitive device and an intermediate transfer device in the FIG. 1 electrophotographic apparatus.

Referring now to FIGS. 1 and 2, a description will be made hereinbelow in terms of an electrophotographic apparatus according to an embodiment of this invention. FIG. 1 is a cross-sectional view showing an arrangement of the electrophotographic apparatus where parts corresponding to those in FIG. 4 are marked with the same numerals, and FIG. 2 is an enlarged view showing a drive section for an intermediate transfer device to be used in the FIG. 1 electrophotographic apparatus. In FIG. 1, a photosensitive device 1 comprises a jointless closed-loop belt-like member made of a resin or the like and having on its circumferential surface a thin film-like photosensitive layer such as a selenium (Se) and an organic photoconductive material (OPC) applied. This photosensitive device 1 is supported by two photosensitive device conveying rollers 2 and 3 so as to form a vertical plane and rotated in a direction indicated by an arrow A in response to the rotations of the two conveying rollers 2 and 3. Around the belt-like photosensitive device 1 there are provided a charger 4, an exposure optical system 5, black (B), yellow (Y), magenta (M) and cyan (C)-color developing devices 6B, 6Y, 6M and 6C, an intermediate transfer unit 7, a photosensitive device cleaning device 8 and a charge-removing device 9 arranged in order in the rotating direction of the photosensitive device 1 indicated by the arrow A. Of these devices, the exposure optical system 5 and the developing devices 6B, 6Y, 6M, 6C are placed on a chassis 38. On the other hand, the photosensitive device 1, cleaning device 8, charger 4, charge-removing device 9 and intermediate transfer unit 7 are provided on a chassis 39. Here, the photosensitive device 1, intermediate transfer unit 7 and others are arranged to be detachable from the chassis 39.

The charger 4 comprises a charging wire 11 made of a tungsten wire or the like, a shield plate 12 made of a metallic plate, and a grid plate 13. In response to a high voltage applied, the charging wire 11 gives rise to corona discharge whereby the photosensitive device 1 can evenly be charged through the grid plate 13. The exposure optical system 5 is controlled in accordance with a signal from a host computer or the like to generate an exposure beam 14 modulated in accordance with image data, thereby forming an electrostatic latent image on the photosensitive device 1. Each of the developing devices 6B, 6Y, 6M and 6C encases the corresponding toner 6c, and for selection of color, one of cams 15B, 15Y, 15M and 15C is rotated in accordance with a color selection signal from a host computer or the like so as to bring the corresponding developing device 6 into contact with the photosensitive device 1. Each of the cams 15B, 15Y, 15M and 15C is at its both ends supported rotatably by the apparatus body. The non-selected remaining developing devices 6 takes the separated state from the photosensitive device 1. The intermediate transfer unit 7 comprises a jointless loop-belt-like intermediate transfer device 16 made of a conductive resin or the like, three intermediate transfer device conveying rollers 17, 18, 19 for supporting the intermediate transfer device 16 to rotate it in a direction indicated by an arrow B, and an intermediate transfer roller 20 for transferring a toner image on the photosensitive device 1 onto the intermediate transfer device 16. The intermediate transfer roller 20 is disposed to be in opposed relation to the photosensitive device 1 so that the intermediate transfer device 16 is interposed therebetween. Numeral 21 denotes a reference sensor for detecting a reference position of the intermediate transfer device 16. The reference position thereof can be detected on the basis of a reference mark such as a slit 16*a* formed at an end portion of the intermediate transfer device 16.

Figure 3A:
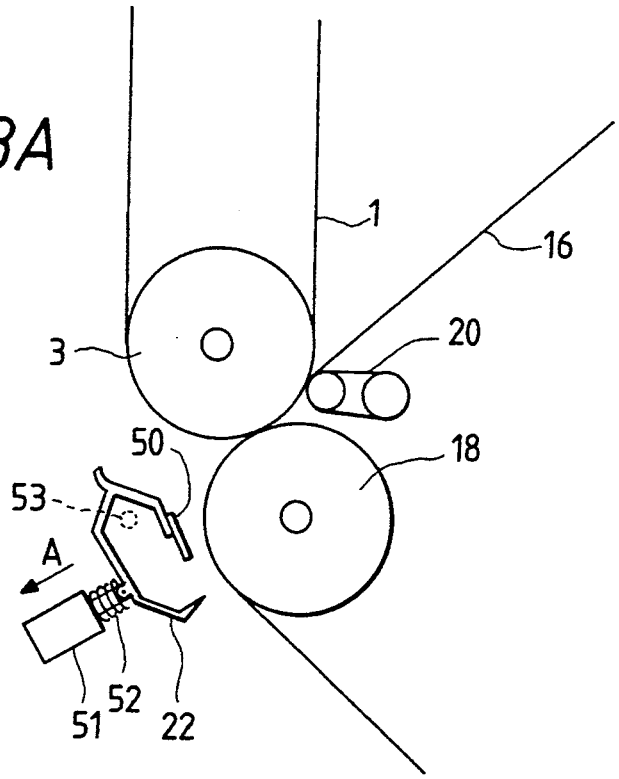
FIGS. 3A and 3B are enlarged views showing the arrangement of a cleaning device in the FIG. 1 electrophotographic apparatus.
Figure 3B:
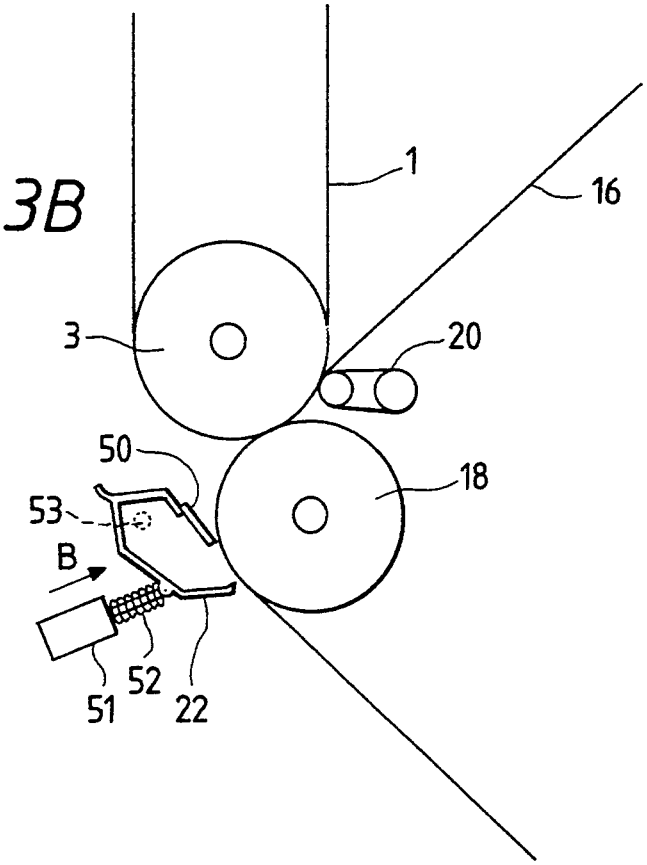

An intermediate transfer cleaning device 22 rakes and removes the remaining toner on the intermediate transfer device 16. As illustrated in FIGS. 3A and 3B, the cleaning device 22 is arranged to be rotatable about a shaft 53 and a blade 50 is brought into contact with the intermediate transfer device 16 to remove the remaining toner thereon, thereby cleaning the intermediate transfer device 16. The cleaning device 22 is entirely pulled by a solenoid 51 in an arrow A direction as illustrated in FIG. 3A while forming a composite image on the intermediate transfer device 16, so that the blade 50 of the cleaning device 22 takes a separated position from the intermediate transfer device 16, and entirely biased in an arrow B direction to come into contact therewith as illustrated in FIG. 3B only when cleaning the intermediate transfer device 16. A transfer member cassette 23 encases transfer members (sheets, paper) 24 and the transfer members 24 are fed from the transfer member cassette 23 one by one to a transfer member conveying passage 26 by means of a feed roller 25 having a semicylindrical configuration. A resist roller 27, contacting with a drive roller 28, temporarily stops the transfer member 24 so that the transfer member 24 takes a waiting state, whereby the transfer position of the transfer member 24 becomes coincident with the position of the composite image on the intermediate transfer device 16. Further, a transfer roller 29 transfers the composite image on the intermediate transfer device 16 onto the transfer member 24. The transfer roller 29 rotationally comes into contact with the intermediate transfer device 16 only when transferring the composite image onto the transfer member 24. A fixing device 30 comprises a heating roller 31 having a heat source therein and a pressing roller 32. The heating roller 31 and the pressing roller 32 hold the transfer member 24 and rotate so that the composite image on the transfer member 24 is fixed to the transfer member 24 due to pressure and heat to form a color image. A transfer member discharging roller 33 is constructed such that an elastic layer such as an urethane is placed on the outer circumference of a base made of a metal such as a stainless steel. The transfer member discharging roller 33 is rotatably supported at a transfer member 24 discharging side end portion of the apparatus body so that the color image-formed transfer member 24 is discharged on the previously discharged transfer members 24 within a transfer member storage device 34 in a state that the color image side of the transfer member 24 becomes the upper side.

Secondly, a description will be made in terms of a drive mechanism for rotationally driving the photosensitive device 1 and the intermediate transfer device 16. In this embodiment, the photosensitive device 1 and the intermediate transfer device 16 are rotationally driven by one drive motor. As illustrated in FIG. 2, one drive motor 42*c* is provided for the rotational drive of both the photosensitive device 1 and intermediate transfer device 16. To a motor shaft of the drive motor 42*c* there is connected a motor shaft gear 42*g* which is in turn engaged with a gear 18*g* provided at one end of the intermediate transfer device conveying roller 18. This gear 18*g* is also arranged to be engaged with a gear 3*g* provided at one end of the photosensitive device conveying roller 3. The photosensitive device 1, intermediate transfer device 16 and drive motor 42*c* are built in the same chassis 39. Further, the gears 3*g* and 18*g* are arranged so that the peripheral speeds of the photosensitive device conveying roller 3 and the intermediate transfer device conveying roller 18 become constant and equal to each other.

The operation of the electrophotographic apparatus arranged as described above is as follows. In response to rotation of the drive motor 42*c*, the photosensitive device 1 and the intermediate transfer device 16 respectively rotate so that their peripheral speeds are constant and equal to each other. Further, the intermediate transfer device 16 has an area previously set by the reference sensor 21 which detects the reference mark 16*a* to determine the reference position. In this state, a high voltage is applied to the charging wire 11 of the charger 4 connected to a high-voltage source so that the corona discharge occurs, while the photosensitive device 1 is rotated in the arrow A direction in FIG. 1, whereby the surface of the photosensitive device 1 is evenly charged to about −700 to −800 V. An exposure beam such as a laser beam 14 corresponding to a given component (for example, black B) of a plurality of color components is applied onto the evenly charged surface of the photosensitive device 1. Due to this application of the exposure beam 14, the charges in the beam-applied portion of the photosensitive device 1 are removed so as to form an electrostatic latent image thereon. At this time, the electrostatic latent image formed area is determined in accordance with a signal from the reference sensor 21 for detecting the reference position of the intermediate transfer device 16. On the other hand, the cam 15B rotates in accordance with a color selection signal from a host computer or the like so that the developing device 6B which encases the black toner 6*c* is pressed in an arrow C direction to be brought into contact with the photosensitive device 1. With this contact, the toner 6*c* is attached to the electrostatic latent image portion on the photosensitive device 1 so as to form a toner image. After the completion of the development, the developing device 6B moves from the contact position up to the separated position by means of rotation of the cam 15B by 180 degrees. The toner image formed on the photosensitive device 1 by the developing device 6B is transferred onto the intermediate transfer device 16 with a high voltage being applied to the intermediate transfer roller 20. This transfer operation is effected at every color. The remaining toner not transferred from the photosensitive device 1 onto the intermediate transfer device 16 is removed by the cleaning device 8 before the charges on the photosensitive device 1 are removed by the charge-removing device 9.

Then, for example, an electrostatic latent image corresponding to cyan (C) is formed on the photosensitive device 1 before rotating the cam 15C to push the developing device 6C toward the photosensitive device 1 which in turn comes into contact with the photosensitive device 1 for the cyan (C) development. In the case of a copying machine or printer using four colors, the aforementioned developing operation is repeatedly effected four times so as to overlap the black (B), cyan (C), magenta (M) and yellow (Y) toner images on the intermediate transfer device 16 to form a composite image thereon. The entire composite image thus formed is transferred onto the transfer member 24, fed from the transfer member cassette 23 through the conveying passage 26, with the transfer roller 29 being brought into contact with and pressed against the intermediate transfer device 16 and a high voltage being applied to the transfer roller 29.

Subsequently, the transfer member 24 to which the toner image is transferred is supplied to the fixing device 30 to be fixed by the heat of the heating roller 31 and the holding pressure by the heating roller 31 and the pressing roller 32 and then discharged onto the transfer member storage device by the rotation of the transfer member discharging roller 33 in the direction indicated by an arrow. The remaining toner on the intermediate transfer device 16 is removed by the cleaning device 22. This cleaning device 22 takes the separated position from the intermediate transfer device 16 until the composite image is formed on the intermediate transfer device 16, and takes the contact state with the intermediate transfer device 16 to remove the remaining toner after the composite image is transferred onto the transfer member 24 by the transfer roller 29. At this time, the image recording is completed.

As described above, in this embodiment the photosensitive device 1 and the intermediate transfer device 16 are rotationally driven by one drive motor 42*c*. The shaft gear 42*g* connected to the shaft of the drive motor 42*c* is engaged with the gear 18*g* at one end of the intermediate transfer device conveying roller 18. The intermediate transfer device 16 is rotatable in response to the rotation of the drive motor 42*c* and the gear 18*g* is engaged with the gear 3*g* at one end of the photosensitive device conveying roller 3 so that the photosensitive device is also rotatable in response thereto, even if the peripheral speed of the intermediate transfer device 16 temporarily varies due to the contacting and separating operations of the cleaning device 22 and the transfer roller 29 with respect to the intermediate transfer device 16. The rotational speed of the gear 18*g* of the intermediate transfer device conveying roller 18 varies in accordance with the peripheral speed of the intermediate transfer device 16 during which a load or force is temporarily applied against the intermediate transfer device 16 and hence the peripheral speed of the photosensitive device 1 rotated by the gear 3*g* quickly varies in accordance with the peripheral speed of the intermediate transfer device 16 because the gear 3*g* is positioned at the downstream side of the gear 18*g* with respect to the drive motor 42*c*, thereby becoming equal to the peripheral speed of the intermediate transfer device 16. This prevents slippage at the transfer portion from the photosensitive device 1 to the intermediate transfer device 16.

It should be understood that the foregoing relates to only preferred embodiments of the present invention, and that it is intended to cover all changes and modifications of the embodiments of the invention herein used for the purposes of the disclosure, which do not constitute departures from the spirit and scope of the invention.

What is claimed is:

1. An electrophotographic apparatus comprising:

a rotatable toner attachment device to which a toner is attached in accordance with image information;

a rotatable intermediate transfer device to which the toners attached to said toner attachment device are transferred, the toners being overlapped so as to form a composite toner image on said intermediate transfer device and said composite toner image being transferred to a recording medium;

a cleaning device arranged to be brought into contact with and separated from said intermediate transfer device for removing toner remaining on said intermediate transfer device after said composite toner image has been transferred to said recording medium, said cleaning device applying a load against said intermediate transfer device when said cleaning device is brought into contact with said intermediate transfer device;

a drive source for rotating both said toner attachment device and said intermediate transfer device so as to prevent slippage between said intermediate transfer device and said toner attachment device due to said intermediate transfer device being subjected to said load, a driving force of said drive source being first transmitted to said intermediate transfer device and then transmitted through said intermediate transfer device to said toner attachment device.

2. An electrophotographic apparatus as claimed in claim 1, wherein said cleaning device rakes off said remaining toner on said intermediate transfer device when brought into contact with said intermediate transfer device.

3. An electrophotographic apparatus as claimed in claim 1, wherein said intermediate transfer device is a jointless closed-loop belt.

4. An electrophotographic apparatus comprising:

a rotatable toner attachment device to which toners are attached in accordance with image information;

a first gear attached to a rotating shaft of said toner attachment device;

a rotatable intermediate transfer device to which the toners attached to said toner attachment device are transferred, the toners being overlapped so as to form a composite toner image on said intermediate transfer device and said composite toner image being transferred to a recording medium;

a second gear attached to a rotating shaft of said intermediate transfer device;

a cleaning device arranged to be brought into contact with and separated from said intermediate transfer device for removing toner remaining on said intermediate transfer device after said composite toner image has been transferred to said recording medium, a load being applied against said intermediate transfer device when said intermediate transfer device is contacted by said cleaning device;

a drive motor for generating a driving force; and a third gear attached to a rotating shaft of said drive motor, wherein said third gear is engaged with said second gear which is in turn engaged with said first gear to rotatably drive said toner attachment device and said intermediate transfer device to thereby prevent slippage between said intermediate transfer device and said toner attachment device caused by said load being applied against said intermediate transfer device.

5. An electrophotographic apparatus comprising:

a toner attachment belt to which toners are attached in accordance with image information;

first roller means for stretching and rotating said toner attachment belt in a predetermined direction;

a first gear provided at one end portion of said first roller means;

an intermediate transfer belt to which the toners attached to said toner attachment belt are transferred, the toners being overlapped so as to form a composite toner image on said intermediate transfer belt, said composite toner image being transferred to a recording medium;

second roller means for stretching and rotating said intermediate transfer belt in a predetermined direction;

a second gear provided at one end portion of said roller means;

a cleaning device arranged to be brought into contact with and separated from said intermediate transfer belt for removing toners remaining on said intermediate transfer belt after said composite toner image has been transferred to said according medium, said cleaning device applying a load to said intermediate transfer belt when in contact therewith;

a drive motor for generating a driving force; and a third gear attached to a rotating shaft of said drive motor, said third gear being engaged with said second gear and said second gear being in turn engaged with said first gear so that said drive motor rotationally drives both said toner attachment belt and said intermediate transfer belt so as to prevent slippage between said toner attachment belt and said intermediate transfer belt due to said load being applied against said intermediate transfer device.

6. An electrophotographic apparatus as claimed in claim 5, wherein said toner attachment belt is a photosensitive belt on which an electrostatic latent image is formed with illumination of light and converted into a toner image by each of a plurality of developing devices encasing a plurality of different color toners, and transferred to said intermediate transfer belt so as to form said composite toner image comprising said plurality of different color toners.

7. An electrophotographic apparatus comprising:

a toner attachment belt on which toner is attached in accordance with image information;

a toner attachment belt driving roller for stretching and rotating said toner attachment belt in a predetermined direction;

a first gear provided at one end portion of said toner attachment belt roller;

an intermediate transfer belt to which said toner is transferred from said toner attachment belt, said toner including different color toners overlapped so as to form a composite toner image on said intermediate transfer belt, said composite toner image being transferred to a recording medium;

an intermediate transfer belt driving roller for stretching and rotating said intermediate transfer belt in a predetermined direction an intermediate transfer belt driven roller for cooperating with said intermediate transfer belt driving roller to stretch and rotate said intermediate transfer belt;

a second gear provided at one end portion of said intermediate transfer belt driving roller;

a cleaning device arranged to be brought into contact with and separated from said intermediate transfer belt for raking off the remaining toner on said intermediate transfer belt after said composite toner image has been transferred to said recording medium, a load being applied by said cleaning device to said intermediate transfer belt when said cleaning device is in contact with said intermediate transfer belt, said cleaning device being disposed in opposed relation to said intermediate transfer belt driving roller so that said intermediate transfer belt is interposed therebetween;

a drive motor for driving both said toner attachment belt and said intermediate transfer belt; and a third gear attached to a rotating shaft of said drive motor;

wherein said third gear is meshed with said second gear and said second gear is meshed with said first gear so that said toner attachment belt and said intermediate transfer belt are driven together by said drive motor without any slippage therebetween irrespective of said load.

8. An electrophotographic apparatus comprising:

a toner attachment belt on which toner is attached in accordance with image information;

a toner attachment belt driving roller for stretching and rotating said toner attachment belt in a predetermined direction;

a toner attachment belt driven roller for cooperating with said toner attachment belt driving roller to stretch and rotate said toner attachment belt:

a first gear provided at one end portion of said toner attachment belt driving roller;

an intermediate transfer belt to which said toner is transferred from said toner attachment belt, said toner including different color toners overlapped so as to form a composite toner image on said intermediate transfer belt, and said composite toner image being transferred to a recording medium;

an intermediate transfer belt driving roller for stretching and rotating said intermediate transfer belt in a predetermined direction;

an intermediate transfer belt driven roller for cooperating with said intermediate transfer belt driving roller to stretch and rotate said intermediate transfer belt;

a second gear provided at one end portion of said intermediate transfer belt driving roller;

a cleaning device arranged to be brought into contact with and separated from said intermediate transfer belt for removing the remaining toner on said intermediate transfer belt after transferring said composite toner image to said recording medium, said cleaning device applying a load to said intermediate transfer belt when in contact therewith;

a drive motor for driving both said toner attachment belt and said intermediate transfer belt; and a third gear attached to a rotating shaft of said drive motor;

wherein said toner attachment belt driving roller is disposed adjacent to said intermediate transfer belt driving roller, said toner is transferred from said toner attachment belt to said intermediate transfer belt at a region near said toner attachment belt driving roller and said intermediate transfer belt driving roller, said third gear is meshed with said second gear and said second gear is meshed with said first gear, whereby said toner attachment belt and said intermediate transfer belt are driven together by said drive motor without any slippage therebetween irrespective of said load.

* * * * *